United States Patent [19]

Hannigan

[11] Patent Number: 5,062,216

[45] Date of Patent: Nov. 5, 1991

[54] SINGLE TIERED MULTI-CYLINDER PAPER DRYER APPARATUS

[75] Inventor: Judson Hannigan, Scarsdale, N.Y.

[73] Assignee: Champion International Corporation, Stamford, Conn.

[21] Appl. No.: 253,440

[22] Filed: Oct. 6, 1988

Related U.S. Application Data

[63] Continuation of Ser. No. 85,163, Aug. 14, 1987, abandoned.

[51] Int. Cl.[5] ..... F26B 5/04

[52] U.S. Cl. ..... 34/16; 34/117; 34/120

[58] Field of Search ..... 34/110, 111, 113, 116, 34/117, 120, 121, 123, 16

[56] References Cited

U.S. PATENT DOCUMENTS

| | | | |
|---|---|---|---|
| 409,615 | 8/1889 | Palmer | 34/121 X |
| 3,079,699 | 3/1963 | Fry, Jr. | 34/13 |
| 3,868,780 | 3/1975 | Soininen et al. | 34/116 |
| 4,183,148 | 1/1980 | Koski et al. | 34/123 X |
| 4,359,828 | 11/1982 | Thomas | 34/114 |
| 4,625,430 | 12/1986 | Aula et al. | 34/123 X |
| 4,625,434 | 12/1986 | Karlsson et al. | 34/123 X |
| 4,654,981 | 4/1987 | Grebe et al. | 34/116 X |
| 4,677,762 | 7/1987 | Futcher | 34/114 |
| 4,934,067 | 6/1990 | Wedel | 34/117 X |

*Primary Examiner*—Henry A. Bennet
*Attorney, Agent, or Firm*—Evelyn M. Sommer

[57] ABSTRACT

Apparatus utilizing a single tier of rotatable cylindrical steam dryers from entrance to exit is provided for the drying of a paper web in a paper-making process. The web is supported by a felt as it traverses the apparatus from dryer to dryer which is transferred between successive dryers by vacuum rolls or suction boxes thereby eliminating open draws between the dryers.

3 Claims, 2 Drawing Sheets

SINGLE TIERED MULTI-CYLINDER PAPER DRYER APPARATUS

This application is a continuation of application Ser. No. 085,163, filed Aug. 14, 1987, now abandoned.

BACKGROUND OF INVENTION

1. Field of Invention

This invention relates to paper making machinery, and more particularly to paper drying apparatus utilizing a single tier of rotatable cylindrical steam dryers extending from one end of the apparatus to the other.

2. Description of the Prior Art

It is well-known in the paper making art to use a raw stock dryer with a preliminary stage consisting of a single tier of steam dryers with a single felt support transporting the web or paper sheet from the paper press to a secondary drying stage. The felt improves contact between the web and the dryer, prevents wrinkling and folding of the paper, absorbs moisture from the web, admits the passage of heat through it, and gives support to the web through contact with the dryer.

A typical design of the individual dryers may be found in U.S. Pat. No. 4,476,637 issued to Justus et al.

The preliminary stage has the advantage of keeping the web, which is very weak as it emerges from the press due to its high initial water content, in constant contact with the felt thereby precluding any rips or tears in the web during this preliminary drying stage. However, because only one side of the web is exposed to the dryers in the preliminary stage, the secondary drying and subsequent stages were achieved through the use of an upper and lower pair of staggered rows of dryers. The web is threaded and sandwiched between a felt and a dryer from one of the rows in the second and subsequent stages, thereby drying one side of the web. The web would then be tensioned because it was unsupported as it moved up or down to be sandwiched between another felt and a dryer from the other row in such a manner as to dry the other side of the web. The space where the web is unsupported but tensioned as it traverses from one row to another is referred to as an "open" or "free" or "unsupported" draw. This alternation from one row of dryers to the other continued throughout the drying process. This general configuration may be found in U.S. Pat. No. 4,378,639 to Walker; U.S. Pat. Nos. 4,495,711 and 4,495,712 both issued to Justus; U.S. Pat. No. 3,778,908 issued to Notbohm; and U.S. Pat. No. 4,625,430 issued to Aula et al. The multi-tiered, staggered dryer configuration necessary to effect drying of opposite sides of the web was also dictated by space saving requirements.

This configuration of dual tiers of dryers, however, poses several disadvantages. The passing of the web unsupported by the felt from one tier to another, resulting in "open" or "free" draws, causes the web to be susceptible to folding, wrinkles or even tears. As the web is frequently unsupported by the felt, a machine directional draw or tension is required to run the web through the dryer, where centrifugal force tends to cause the web to move away from contact with the dryer surfaces. The "unsupported" web may also freely shrink in a cross dimension, thereby causing curl or "edge cockles". Similarly, start-up of this apparatus is difficult in that the web must be threaded through the dryers and various rollers. This is typically accomplished by the use of ropes along the edge of the web.

This use of threading ropes not only presents a maintenance and safety concern but also reduces the width of the web which may be supported by the felt and results in instability of the edges of the web on the felt thereby reducing paper production yield and increasing distortions in the final product. Additionally, in order to prevent curl in the final paper product, a fine monitoring and adjustment of any temperature differential between the upper and lower row of dryers and felts must be maintained, as a temperature differential on each side of the web being dried may cause the web to curl. Furthermore, the double-tier design presents a very dense framework including steam pockets between the dryers, thereby not allowing the easy escape of moisture vapor, resulting in high humidity and inefficient cooling. Such a dense framework is difficult to access during maintenance or repair.

In accordance with the present invention, it has been found that by extending the single tier dryer configuration throughout the drying section of the apparatus from entrance to exit with a vacuum supported draw free transfer of the web from one dryer to the next, although retaining the drying of opposite sides of the web in discrete stages, all open draws are eliminated along with the many problems enumerated in the prior art two-tier dryer system, improving runnability. Use of this configuration throughout the dryer results in a lesser number of dryers being required to achieve drying of the web with resulting savings in energy and maintenance, than in the prior art system. The reduction in the number of dryers in such a single tier configuration is the result of three factors: the felt wrap is increased by decreasing the spacing between dryers, the ambient humidity is decreased because the enclosed pockets between the dryers are eliminated, the moisture vapor is free to escape and the sheet temperature is more readily maintained by minimizing the sheet length between dryers. Consequently, the drive load is reduced by having fewer dryers and less steamfit drag.

SUMMARY OF THE INVENTION

In accordance with the present invention, upon removal from the paper press, a paper web is supported by a felt which follows a serpentine path through a single tier of standard cylindrical dryers, located in separate stages throughout the dryer section. The rotation of the steam dryers is driven by the felt instead of a gear train, so that if the dryers have slightly different diameters due to manufacturing tolerances or differences in steam pressure or the like, there is no variation in the surface speeds of the individual dryers, thereby improving the runnability of the sheet. Dryers which are geared together are forced to run at equal rotational speeds, and variations in diameters of the dryers would translate to unequal dryer surface speeds which would not only increase the drive power but would result in uneven web movement inducing many of the prior art problems.

In between each dryer is a vacuum roll or box which serves a dual function. The first and most important function is that it provides positive web movement control without tensioning the web by holding the paper or web to the felt as it transfers between dryers, thereby eliminating both the "open draws" of the prior art wherein an unsupported web passed between different tiers of dryers, possibly running at slightly different speeds, and the need for a machine-directional web tension in order to assure sheet runnability. All of these elements—the unsupported web, the felt speed variations, and the machine directional web tension—contributed to flaws in the final paper product in the prior art and are eliminated in accordance with the herein disclosed drying apparatus providing maximum sheet restraint. The second function is that it eliminates any extended length of the paper web being free between dryers and guides the felt and web such that the web is restrained between the felt and the dryer, resulting in more uniform temperature of the entire drying web.

Adjacent to each dryer is an air nozzle and in designated instances a radiant induction heater. The radiant heater can extend across the width of the web and the air nozzle associated with the heater can blow hot air warmed by the heater against the web to provide for removal of moisture and water vapor from the sheet and provide for differential drying. The air nozzle performs an additional function and namely assists in the threading process. The hot air blast also aids in blowing the web against the felt as the felt leaves a dryer and moves towards the vacuum transfer roll or box. A doctor blade adjacent each dryer is also provided to scrape the web from the dryer to prevent wrapping of the dryer and to keep the dryer clean. This arrangement, along with the vacuum transfer eliminates the threading of the web by the use of ropes during the start-up process thereby reducing maintenance.

After the felt and web have passed a given number of dryers, the web is transferred to another stage provided with another felt. The transfer is effected by vacuum transfer rollers or a suction box in such a manner that the side of the web previously in contact with the felt is now in direct contact with the dryers, and vice versa. This procedure is repeated through a number of stages and results in more uniform drying of the web. Energy requirements can be controlled as the temperatures of the various stages may be regulated so as to control the amount of drying on either side of the web. This effectively controls the curl of the final product, as well. The transfer between stages is accomplished by sandwiching the web between the felts of adjacent stages and using the vacuum transfer roll or box of a subsequent stage to pull the web away and reverse its orientation from the felt of the previous stage, so the web is on the inside of the felt while drying.

BRIEF DESCRIPTION OF THE DRAWINGS

Further objects and advantages of the invention will become more apparent from the following description and claims, and from the accompanying drawings wherein:

DETAILED DESCRIPTION OF THE PREFERRED EMBODIMENT

Figure 1:
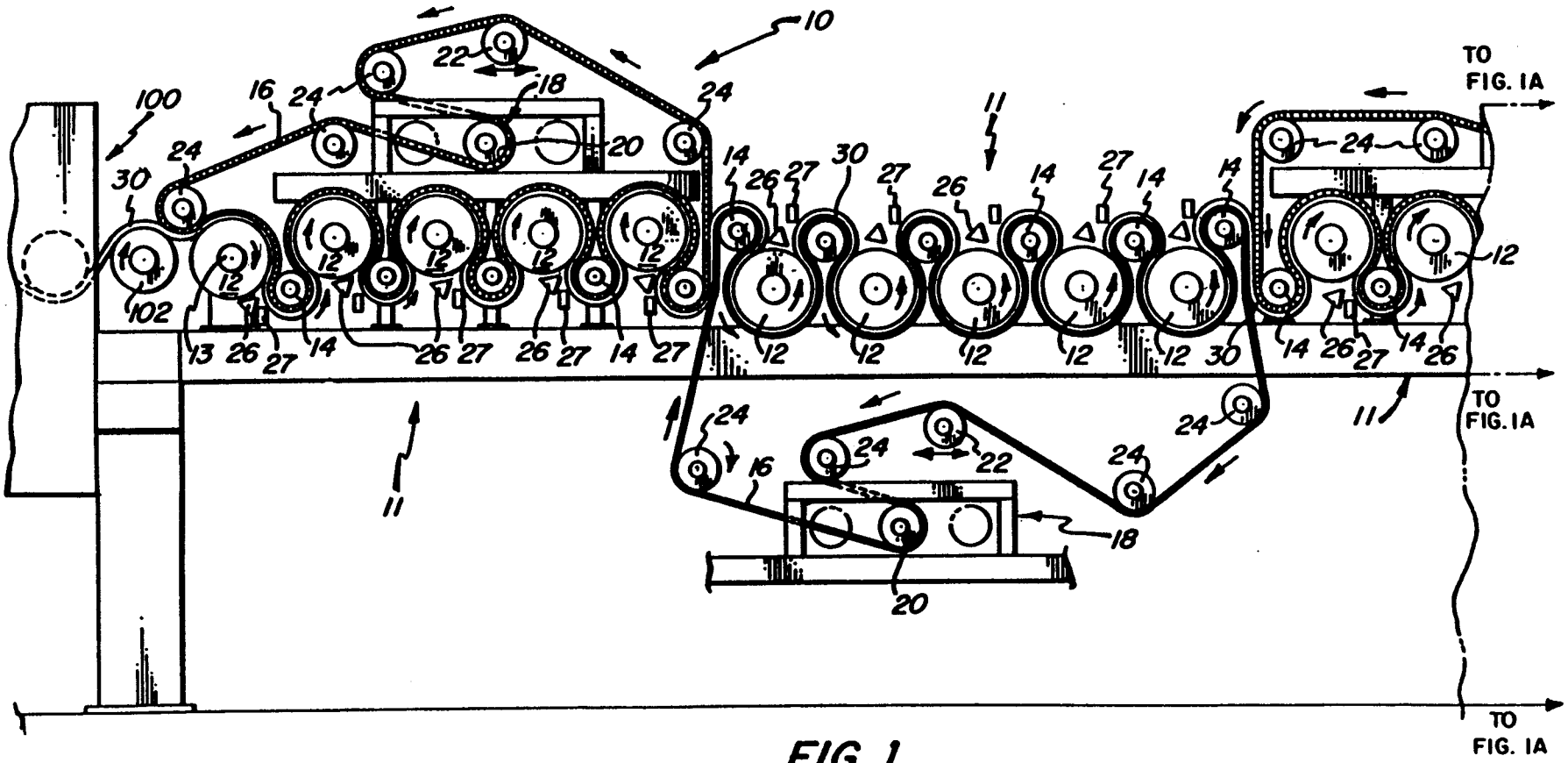
FIG. 1 is a view in side elevation of the first several dryer stages of the apparatus of the present invention.
Figure 1A:
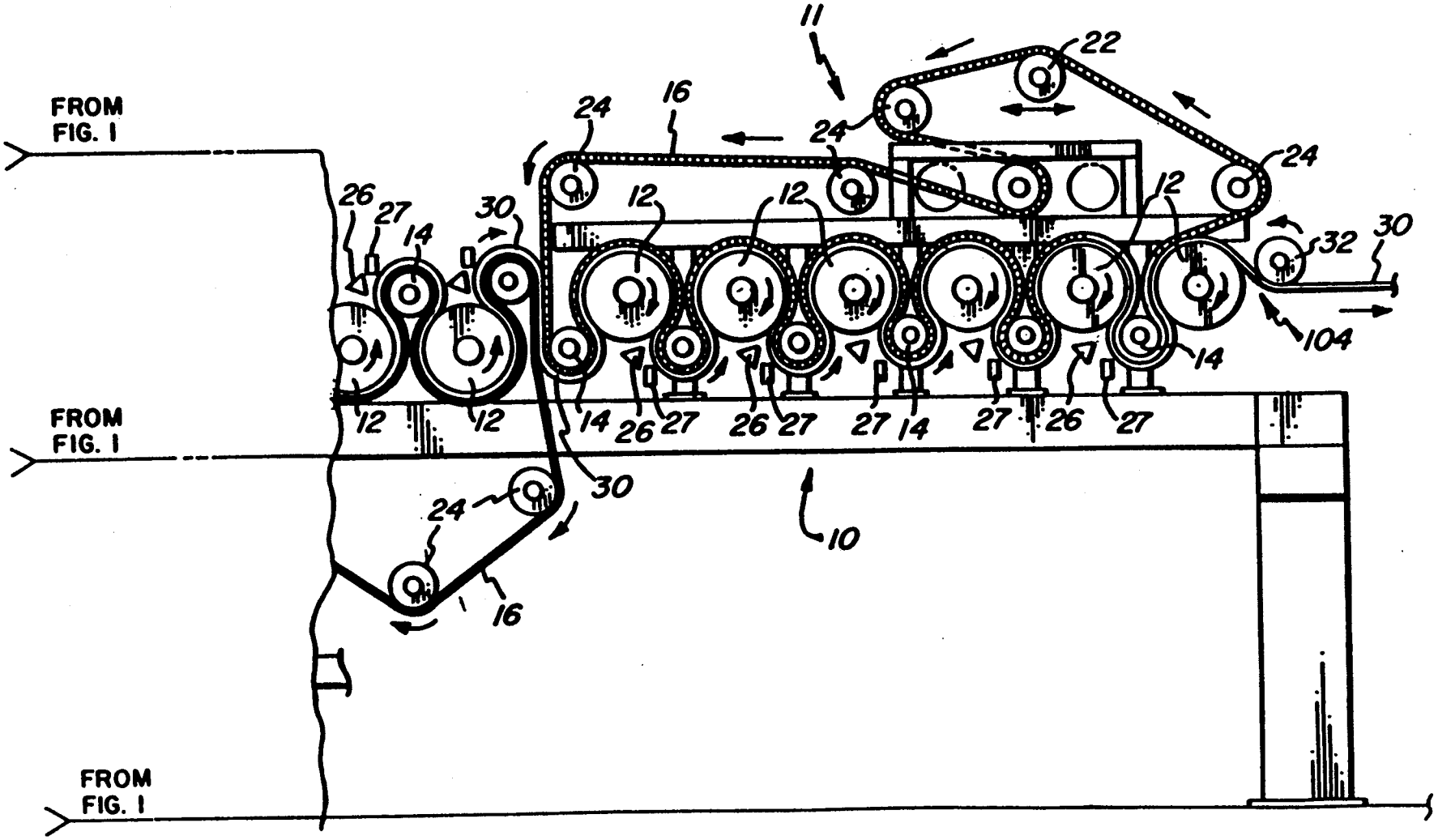
FIG. 1A is a view in side elevation showing an extension of and the final stage of the apparatus of FIG. 1.

Referring now to the drawings in detail, wherein like numerals indicate like elements throughout the several views, the dryer apparatus 10 of the present invention is designed to be stationed at the exit of a paper press apparatus 100.

Apparatus 10 consists of a single tier of tandem, rotatable cylindrical steam dryers 12 extending from the dryer entrance at the exit of press 100 to the dryer exit at 104. The design of the individual rotatable cylindrical steam dryers 12 is well-known in the prior art, and does not form part of the present invention. Generally, the rotatable cylindrical steam dryers 12 are journalled for rotation about their axis 13, and have rotating joints provided with vents through which steam is emitted to dry a paper web 30 emerging from press 100.

The single tier of rotatable cylindrical steamdryers 12 may be subdivided into a plurality of stages of approximately five rotatable cylindrical steam dryers 12, each stage being indicated by the numeral 11. The axes 13 of the first and subsequent odd stages of the rotatable cylindrical steam dryers 12 are offset higher in a vertical direction than the axes 13 of the second and subsequent even stages of the rotatable cylindrical steam dryers 12.

In the interstices between the rotatable cylindrical steam dryers 12 are vacuum transfer rolls or suction boxes 14. The axes of these vacuum rolls 14 are at approximately the lowest level of the circumference of rotatable cylindrical steam dryers 12 in the first and subsequent odd stages 11. Similarly, the axes of the vacuum rolls or boxes 14 are at approximately the highest level of the circumference of the rotatable cylindrical steam dryers 12 in the second and subsequent even stages 11. At the interfaces between each of the stages 11 of the rotatable cylindrical steam dryers 12, there are two vacuum rolls or suction boxes 14, one at the level corresponding to the odd stage of rotatable cylindrical steam dryers 12 and another at the level corresponding to the even stage of rotatable cylindrical steam dryers 12. Vacuum is drawn in rolls or boxes 14 in a conventional manner well-known in the art and the vacuum may be controlled by opening and closing a damper (not shown) in each roll or box.

Each stage 11 of the apparatus 10 includes an endless felt 16 which enters the side of each stage closer to the press 100 and travels a serpentine path around, including a sector greater than 180° of the circumference, each of a succession of alternating rotatable cylindrical steam dryers 12 and vacuum rolls 14. Upon exiting the side of the stage 11 away form the press 100, the felt 16 travels through a drive mechanism 18 which includes a drive roller 20, a tension roller 22, and idler rollers 24 before reentering the side of the stage 11 closer to the press 100. As the rotatable cylindrical steam dryers 12 in each stage are journalled for rotation about their axes 13, they are driven by the endless felt 16 in each stage 11 and rotate with a synchronized surface speed.

Adjacent to each dryer 12 is an air nozzle and in some instances a radiant induction heater 27. It is possible for each dryer to be provided with a radiant induction heater but this is not required or necessary. The radiant heater can extend across the width of the web and an air cap can blow hot air warmed by a heater against the web to provide for removal of moisture and water vapor from the sheet and provide for differential drying. The hot air blast also aids in blowing the web against the felt belt as the felt leaves a dryer and moves towards the vacuum transfer roll or box 14. The air nozzle also is instrumental in the threading process. A doctor blade 26 adjacent each dryer is also provided to scrape the web from the dryer to prevent wrapping of the dryer and to keep the dryer clean.

Between adjacent stages 11 of the rotatable cylindrical steam dryers 12, the felts 16 of the adjacent stages 11 run in tandem, with their runs one above the other, to define a linear path between the vacuum rolls or suction boxes 14 at the exit and entrance of each stage.

In use, a paper web 30 to be dried is withdrawn from the paper press 100 over roller 102 (although a variety of alternative configurations can be used) and inserted between the felt 16 and the first rotatable cylindrical steam dryer 12 of the first stage 11. As the web 30 and felt 16 traverse the first rotatable cylindrical steam dryer 12, the web 30 is held tightly to the rotatable cylindrical steam dryer 12 by the felt 16. As the felt 16 and web 30 move away and approach the vacuum transfer roll or suction box 14 from the rotatable cylindrical steam dryer 12, the air nozzles/heater 27 blow the web 30 against the felt 16. The doctor blade 26 assures removal of the web 30 from the circumference of steam dryer 12 by contact therewith if the web adheres to the circumference of the dryer. The web 30 and felt 16 then immediately traverse the periphery of the vacuum roll or suction box 14 with the felt 16 between the web 30 and the vacuum roll or suction box 14. The felt 16 and web 30 then are moved into contact with the circumference of the next rotatable cylindrical steam dryer 12 with web 30 in contact with the surface of the dryer and the process described above is repeated as the felt 16 and web 30 traverse approximately five rotatable cylindrical steam dryers 12 for each drying stage.

After the felt 16 and web 30 have traversed all of the rotatable cylindrical steam dryers 12 of a drying stage 11, the web 30 is sandwiched between the opposed runs of felts 16 of two successive drying stages 11. A vacuum transfer roll or suction box 14 at the entrance to the next stage is used to transfer the web 30 from one felt 16 to the felt 16 in the next stage, reversing the orientation of the web 30, thereby assuring that both sides of the web are equally dried by contact with the dryers in successive stages. After the final stage, the web 30 is withdrawn by a series of rollers 32 at exit 104.

The felts 16 are always in contact with the web 30 throughout the length of the apparatus 10 thereby eliminating "open draws" where the web 30 would be unsupported and susceptible to uneven heating, tearing and distortion i.e., maximum sheet restraint is provided. The subsequent drying stages alternate the side of the web 30 in direct contact with the rotatable cylindrical steam dryers 12.

The use of air nozzles 27 and vacuum rolls or suction boxes 14 in the guiding of the web 30 eliminates the need for manual threading of the web 30 using prior art threading ropes during start-up of the apparatus 10. The apparatus 10 is therefore easy to maintain.

The single tier of the apparatus 10 also allows moisture laden air to escape, reducing ambient humidity, minimizes sheet length between dryers, thus maintaining the web temperature and results in increases in felt contact, allowing for more efficient runnability with reduced energy requirements and number of dryers required in the drying run.

What is claimed is:

1. A process for drying a paper web, said process comprising the steps of:

arranging first and second pluralities of consecutive cylindrical dryers in a single tier in tandem;

entraining a first run of the web on said first plurality of cylindrical dryers such that one face of said web is exposed to said first plurality of cylindrical dryers;

entraining a second run of the web on said second plurality of cylindrical dryers such that the opposite face of said web is exposed to said second plurality of cylindrical dryers;

rotating sad first plurality of cylindrical dryers in one direction and said second plurality of cylindrical dryers in the opposite direction;

overlaying said first run of said web with a a second endless belt which moves in concert therewith;

overlaying said second run of said web with a second endless belt which moves in concert therewith; .

moving a run of said first endless belt and a run of said second endless belt adjacent to each other at an interface between said first and second pluralities of cylindrical dryers, the interface comprising a first section where said endless belts define parallel planes and a second section where one of said belts defines a second plane substantially tangent to the other belt, the second plane being aligned to intersect the parallel planes; and sandwiching said web between said run of said first endless belt and said run of said second endless belt at said interface to transfer said web from said first plurality to said second plurality of cylindrical dryers, whereby said web is fully supported between said first and second endless belts throughout the interface between the first and second pluralities of cylindrical dryers.

2. A process as set forth in claim 1 wherein said run of said first and second endless belts are positioned at the interface by:

entraining said first endless belt at said interface partially around a first vacuum transfer roller journaled for rotation about an axis approximately parallel to the axes of said first plurality of consecutive dryers and disposing a portion of said first endless belt in a vertical plane at said interface by entraining said first endless belt about an idler roller journaled for rotation about an axis which is also parallel to the axes of said first plurality of consecutive dryers, said vacuum transfer roller sandwiching said first endless belt and said web between itself and a cylindrical dryer of said first plurality; and entraining said second endless belt at said interface around a second vacuum transfer roller journaled for rotation about an axis approximately parallel to the axes of said second plurality of consecutive dryers and disposing a portion of said second endless belt in a plane at an angle to said vertical plane by entraining said second endless belt about an idler roller journaled for rotation abut an axis which is also parallel to the axes of said second plurality of consecutive dryers, said second vacuum transfer roller sandwiching said second endless belt and said web between itself and a cylindrical dryer of said second plurality.

3. A process for drying a paper web, said process comprising the steps of:

entraining a first run of said web on a first plurality of consecutive cylindrical dryers arranged in tandem to expose one face of said web thereto;

entraining a second run of said web on a second plurality of consecutive cylindrical dryers arranged in tandem to expose the opposite face of said web thereto;

rotating said second plurality of cylindrical dryers in one direction and said second plurality of cylindrical dryers in the opposite direction;

transferring said web from said first plurality of cylindrical dryers to said second plurality of cylindrical dryers, and reversing said web during said transfer;

overlaying said first run of said web entrained on said first plurality of cylindrical dryers with a first endless belt to move in concert therewith; and overlaying said second run of said web entrained on said second plurality of cylindrical dryers with a second endless belt to move in concert therewith; and wherein the transferring step comprises the steps of:

moving a run of said first endless belt adjacent a run of said second endless belt at a interface between said first and second pluralities of cylindrical dryers, the interface comprising a first section where said endless belts define parallel planes and a second section where one of said belts defines a second plane substantially tangent to the other belt, the second plane being aligned to intersect the parallel planes; and sandwiching said web between said run of said first endless belt and said run of said second endless belt at said interface to transfer said web from said fist plurality to said second plurality of cylindrical dryers, whereby said web is fully supported between said first and second endless belts throughout the interface between the first and second pluralities of cylindrical dryers.

* * * * *